United States Patent [19]

Watkins

[11] Patent Number: 4,465,134

[45] Date of Patent: Aug. 14, 1984

[54] TIE-BACK CONNECTION APPARATUS AND METHOD

[75] Inventor: Bruce J. Watkins, Palos Verdes, Calif.

[73] Assignee: Hughes Tool Company, Houston, Tex.

[21] Appl. No.: 402,180

[22] Filed: Jul. 26, 1982

[51] Int. Cl.[3] ..... E21B 43/01

[52] U.S. Cl. ..... 166/245; 166/123; 285/39

[58] Field of Search ..... 166/338–349, 166/120–125, 382; 285/39

[56] References Cited

U.S. PATENT DOCUMENTS

| | | | |
|---|---|---|---|
| 3,108,638 | 10/1963 | Burns | 166/124 |
| 3,201,147 | 8/1965 | De Cenzo | 285/1 |
| 3,220,245 | 11/1965 | Van Winkle | 73/46 |
| 3,222,088 | 12/1965 | Haeber | 285/18 |
| 3,347,567 | 10/1967 | Watkins | 285/24 |
| 3,452,815 | 7/1969 | Watkins | 166/0.5 |
| 3,468,558 | 9/1969 | Ahlstone | 166/340 X |
| 3,485,051 | 12/1969 | Watkins | 61/46.5 |
| 3,492,027 | 1/1970 | Herring | 285/18 |
| 3,493,043 | 2/1970 | Watkins | 166/0.5 |
| 3,613,726 | 10/1971 | Torres | 285/86 |
| 3,779,313 | 12/1973 | Regan | 166/0.6 |
| 3,856,081 | 12/1974 | Canalizo | 166/123 |
| 3,918,747 | 11/1975 | Putch | 285/39 X |
| 4,289,206 | 9/1981 | Kirkland | 166/341 X |
| 4,326,328 | 4/1982 | Watkins | 29/464 |
| 4,333,528 | 6/1982 | Woodman | 166/117.5 |
| 4,343,495 | 8/1982 | Nobileau et al. | 285/39 X |

*Primary Examiner*—Ernest R. Purser

*Attorney, Agent, or Firm*—Robert A. Felsman; James E. Bradley

[57] ABSTRACT

A tie-back connection apparatus effects a metal-to-metal type seal between a riser run from an overhead vessel and a subsea well casing suspended from a casing hanger in a subsea wellhead member. The apparatus includes a tubular mandrel connected to and run by the riser into the wellhead. A metal-to-metal type annular seal ring, mounted at the lower end of the mandrel, is landed upon the casing hanger, with the end of the mandrel in coaxial alignment with the casing hanger. The seal ring effects a seal between the riser and the casing when compressive force is applied to the seal ring. A seal activating mechanism, operated by a tool run from the vessel, engages the casing hanger and applies the compressive force to effect the seal. The seal activating mechanism includes three locking collets, a reaction sleeve, and a drive sleeve. One collet engages the casing hanger. The tool first rotates the drive sleeve to move the reaction sleeve upwardly to maintain the first collet in engagement with the casing hanger and to engage the second locking collet. Thereafter, hydraulic force is applied to the reaction sleeve via the second collet to urge the mandrel downwardly against the casing hanger via the third collet to apply the compressive force to the seal. Thereafter, the drive sleeve is rotated against the mandrel to maintain the compressive force and allow the hydraulic force to be released and the operating tool removed. A method is also provided for effecting a metal-to-metal type seal between the riser and the casing.

17 Claims, 14 Drawing Figures

Fig. 3.a
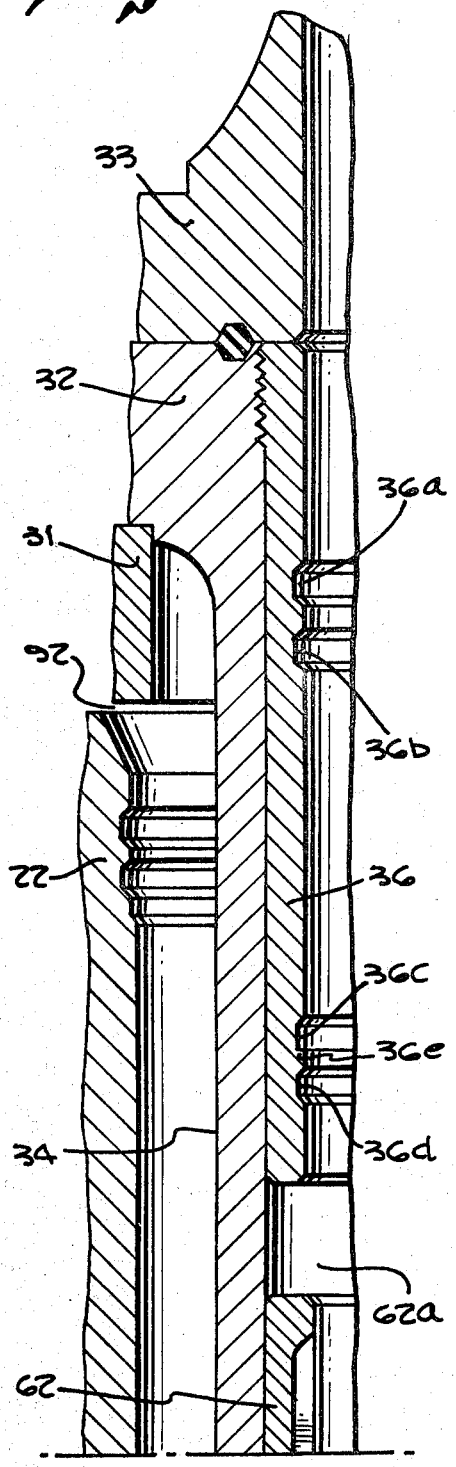
Fig. 3.b
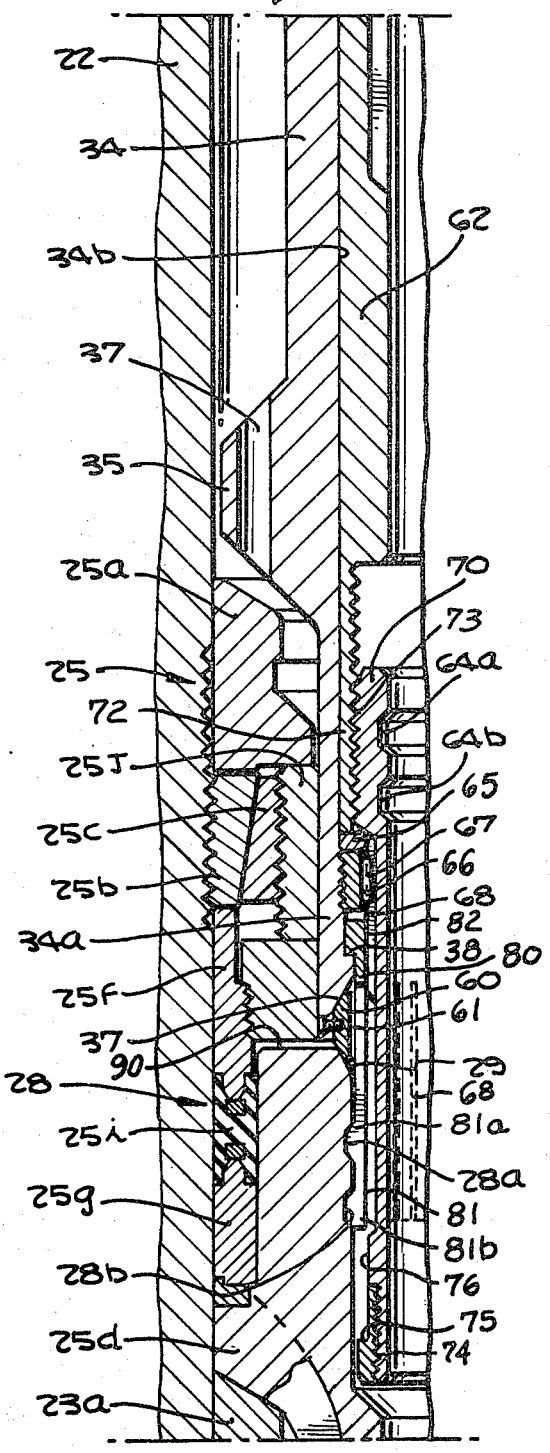

Fig. 3c
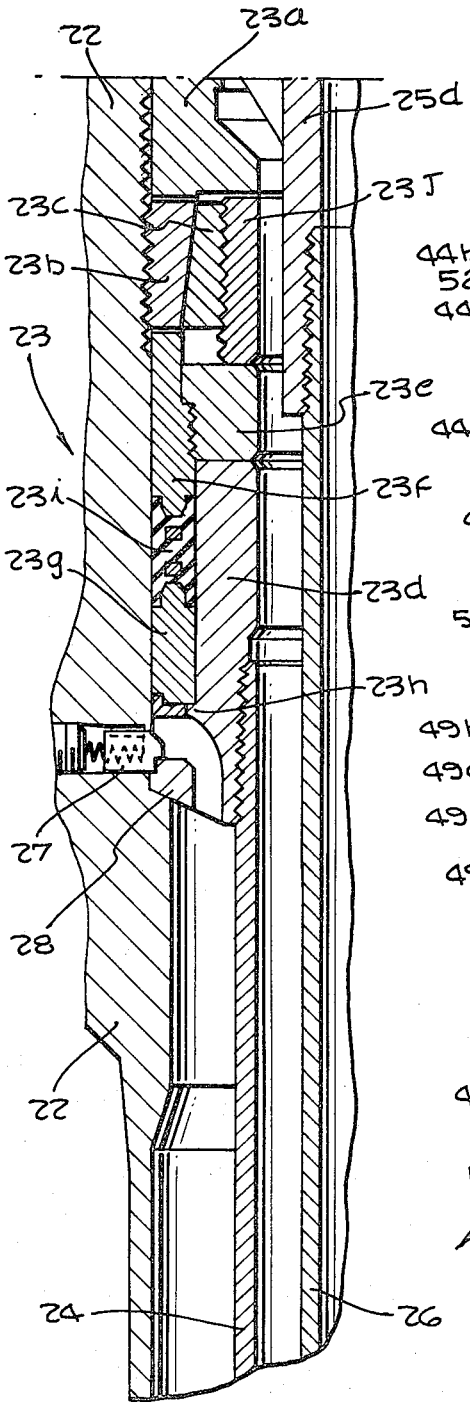
Fig. 5.
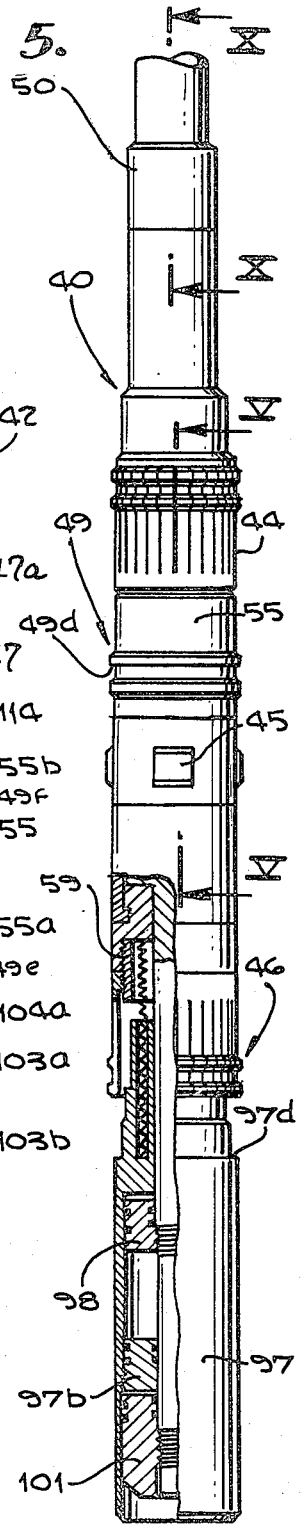
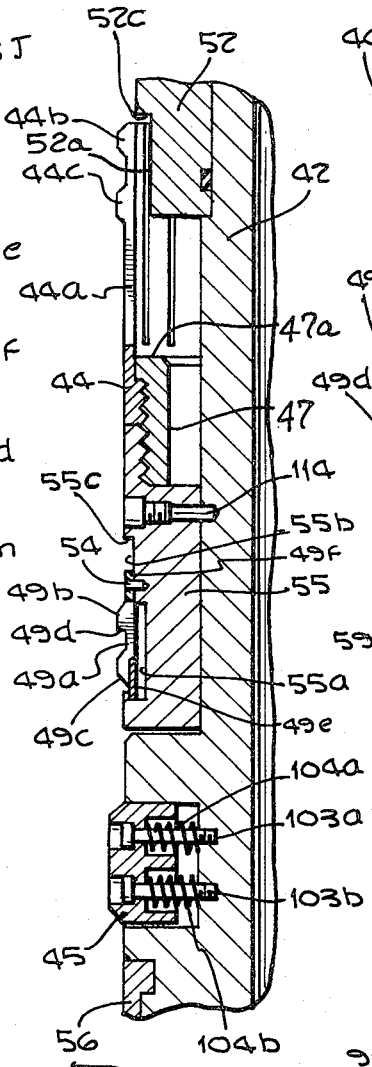
Fig. 4.

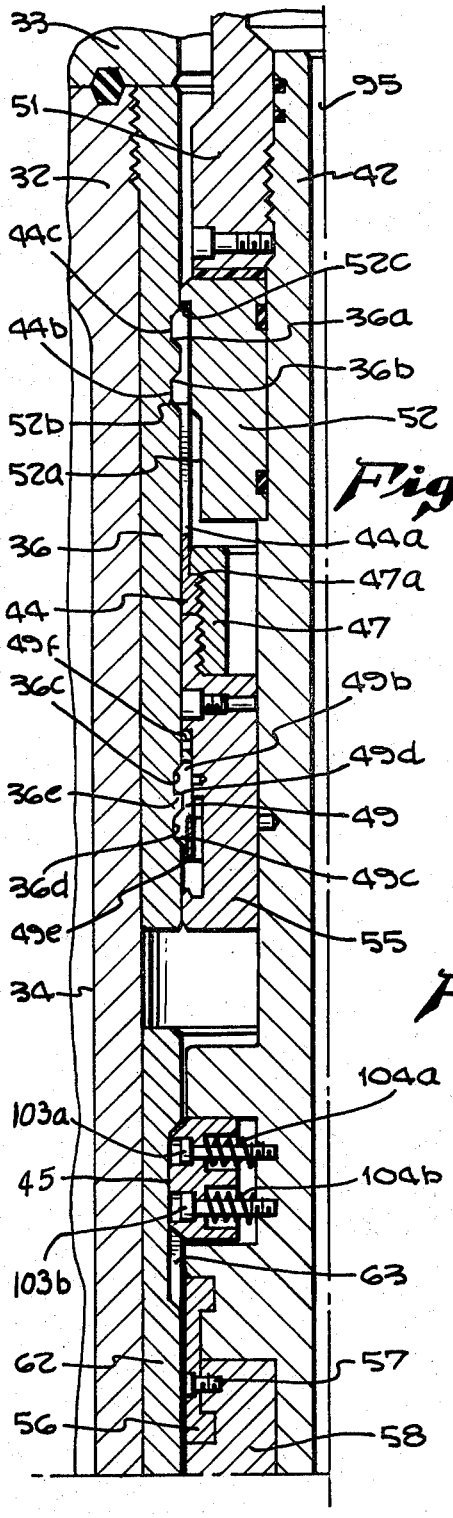
Fig. 8.a
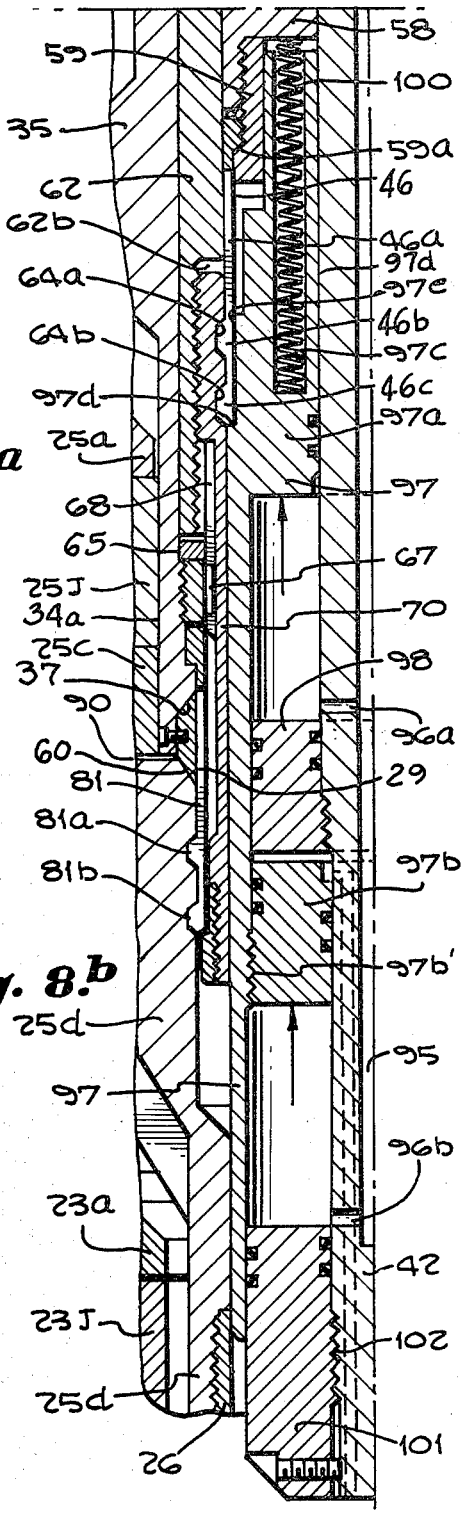
Fig. 8.b

TIE-BACK CONNECTION APPARATUS AND METHOD

CROSS-REFERENCE TO RELATED APPLICATION

This application and an application filed by me entitled "TIE-BACK CONNECTION METHOD AND APPARATUS" filed July 26, 1982, Ser. No. 401,508 contained some common subject matter.

FIELD OF THE INVENTION

The present invention relates to the remote latching and sealing of a riser run from a floating vessel to a subsea wellhead.

BACKGROUND OF THE INVENTION

In offshore production well systems, it is desirable to be able to quickly and effectively reconnect a piping string to a subsea wellhead. One of the primary problems which must be overcome in so doing, however, is the difficulty in creating an effective seal between the riser and the casing in the subsea wellhead. One of the seals that has been utilized in subsea connections is a metal-to-metal type seal.

The metal-to-metal type seal, to be effective, requires that a high compressive force be placed on it. The mechanisms previously used in connection with the metal-to-metal seal have been complicated and cumbersome and have not provided the desired degree of sealing between the riser and the subsea casing. As a result, the remote latching and sealing of the tie-back string to the wellhead has gone neither as smoothly, nor as quickly, as desired.

Accordingly, it is principal object of the present invention to remotely latch and seal a tie-back string to a production wellhead.

Another object of this invention is to remotely latch and seal a tie-back string to a production wellhead quickly and efficiently.

A further object of this invention is to apply hydraulic compressive force to a metal-to-metal type seal and to thereafter mechanically retain the applied compressive force.

SUMMARY OF THE INVENTION

The present invention, in a broad aspect, provides a tie-back connection apparatus to effect a metal-to-metal type seal between a riser run from an overhead vessel and a subsea well casing suspended from a casing hanger in a subsea wellhead member. The apparatus includes a tubular mandrel connected to and run by the riser into the subsea wellhead, with the bore of the mandrel communicating with the bore of the riser. A metal-to-metal type annular seal is mounted at a lower end of the mandrel. The lower end of the mandrel is guided into the wellhead member in coaxial alignment with the casing hanger, with the seal ring positioned therebetween. Mating metal-to-metal surfaces are provided between the seal ring and the lower end of the mandrel and the casing hanger to effect a seal therebetween upon application of compressive force thereto. A seal activating mechanism associated with the mandrel engages the casing hanger and, in response to a linear sealing force, applies a compressive force between the seal ring, mandrel and casing hanger to seal the connection thus effected between the riser and the casing. The seal activating mechanism, in response to a rotative seal retaining force applied after the linear sealing force, maintains the compressive force on the seal.

In accordance with one feature of the invention, the linear force is a hydraulic force and the rotative force is a mechanical force. Each of these forces is applied by an operating tool run from the vessel through the riser into the mandrel. The operating tool applies the hydraulic force to the seal activating mechanism to seal the connection between the riser and the casing and then applies the mechanical force to maintain the seal.

In accordance with yet another feature of the invention, the seal activating mechanism includes three locking collets, the first one of which extends into and engages the casing hanger. The seal activating mechanism also includes a drive sleeve slidably mounted for both linear and rotative movement within and relative to the mandrel. A reaction sleeve, slidably mounted for and constrained to linear movement within the mandrel, threadingly engages the drive sleeve. The drive sleeve is first rotated by the tool to move the reaction sleeve upwardly to engage the second locking collet, and to retain the first collet engaged with the casing hanger. The linear hydraulic force is thereafter applied by the tool against the reaction sleeve and the second locking collet. The second collet inhibits movements of the reaction sleeve, whereupon the hydraulic force is transferred downwardly against the third locking collet, thereby pushing the mandrel against the casing hanger to apply the compressive force. Thereafter, the drive sleeve is rotated by the tool downwardly against the mandrel to maintain axial tension on the reaction sleeve and thus maintain the compressive force on the mandrel, seal, and casing hanger.

In accordance with a further feature of the invention, the operating tool includes a tool body run by tubing from the vessel through the riser into the mandrel. The tool has a vertical registration apparatus which engages the mandrel to properly position the tool body in the mandrel bore. Dogs extending from the tool body engage the drive sleeve to apply the rotative force to the drive sleeve to both initially position the reaction sleeve and to maintain the compressive force applied to the seal. An annular piston, hydraulically actuable from the vessel, engages the reaction sleeve and applies the compressive force. The load is thereafter maintained when the dogs rotate the drive sleeve vertically downward against the mandrel.

In accordance with yet another feature of the invention, a method of effecting a metal-to-metal type seal between the riser and the subsea well casing includes the lowering of a mandrel attached to the riser and having a metal-to-metal type annular seal mounted at the lower end thereof into the subsea wellhead member. The annular seal is thereafter landed on and in coaxial alignment with the casing hanger to effect a connection between the riser and the casing. A compressive force is hydraulically applied to the seal ring, mandrel, and casing hanger to seal the effective connection. A mechanical force is thereafter used to retain the compressive force, thereby allowing the releasing of the hydraulic force.

Other objects, features, and advantages of the present invention will become apparent by a consideration of the following detailed description and from the accompanying drawings.

BRIEF DESCRIPTION OF THE DRAWINGS

FIG. 3*a* is a fragmentary sectional view showing the uppermost portion of the tie-back apparatus immediately after landing in the subsea wellhead;

FIG. 3*b* is a fragmentary sectional view of the tie-back apparatus and subsea wellhead, taken below FIG. 3*b;*

FIG. 3*c* is a fragmentary sectional view showing the lowermost portion of a subsea wellhead, taken below FIG. 3*b;*

FIG. 4 is an elevational view, partially in section, of the operating tool portion of the present invention;

FIG. 5 is a sectional view, taken through the plane V—V of the operating tool shown in FIG. 4;

FIG. 8*a* is an enlarged fragmentary sectional view showing the lifting of the reaction sleeve in the tie-back apparatus by the piston in the operating tool to seal the tie-back apparatus to the subsea wellhead;

FIG. 8*b* is a view of the tie-back apparatus and operating tool taken below FIG. 8*a;*

DETAILED DESCRIPTION OF THE DRAWINGS

Figure 1:
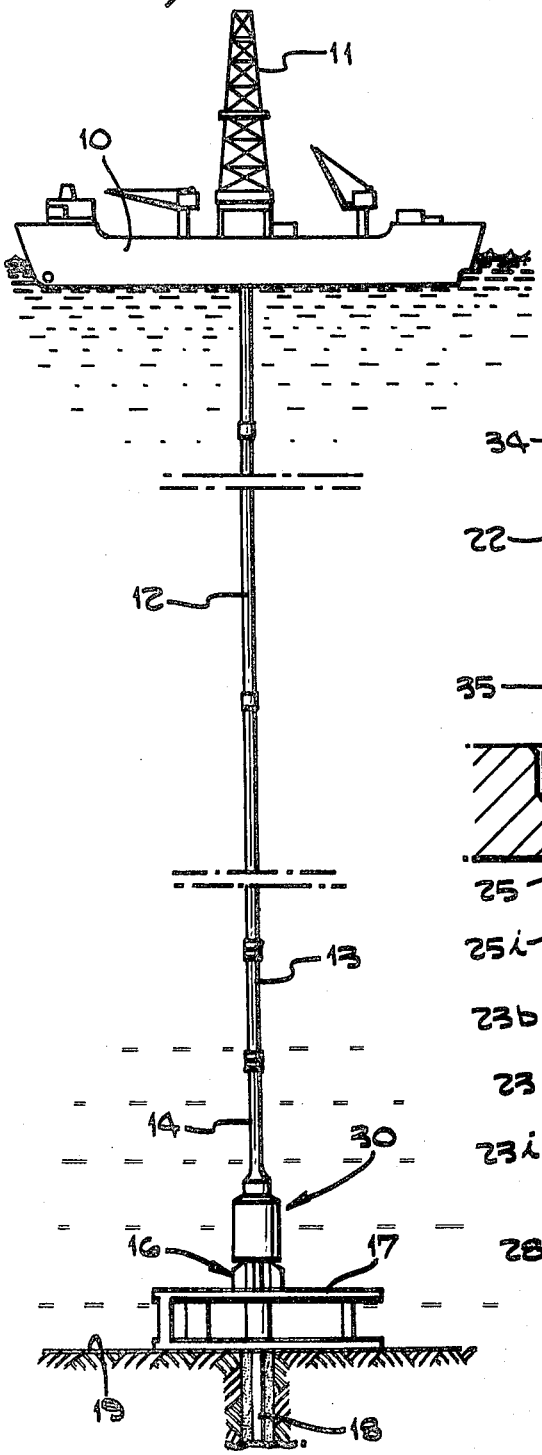
FIG. 1 is a schematic view of a vessel positioned over a sea floor template and having a descending pipe string provided with a tie-back connection apparatus of the present invention.

Referring more particularly to the drawings, FIG. 1 shows a schematic view of a subsea production well system including a well 18 on the subsea floor 19. The well 18 is connected to a template 17 having mounted thereon a wellhead assembly 16. Attached to the wellhead assembly 16 is a tie-back connection apparatus 30 according to the present invention, which itself is connected to a tapered joint 14 attached to a riser 13 connected to a riser string 12 from a rig 11 on a floating vessel 10.

Figure 2:
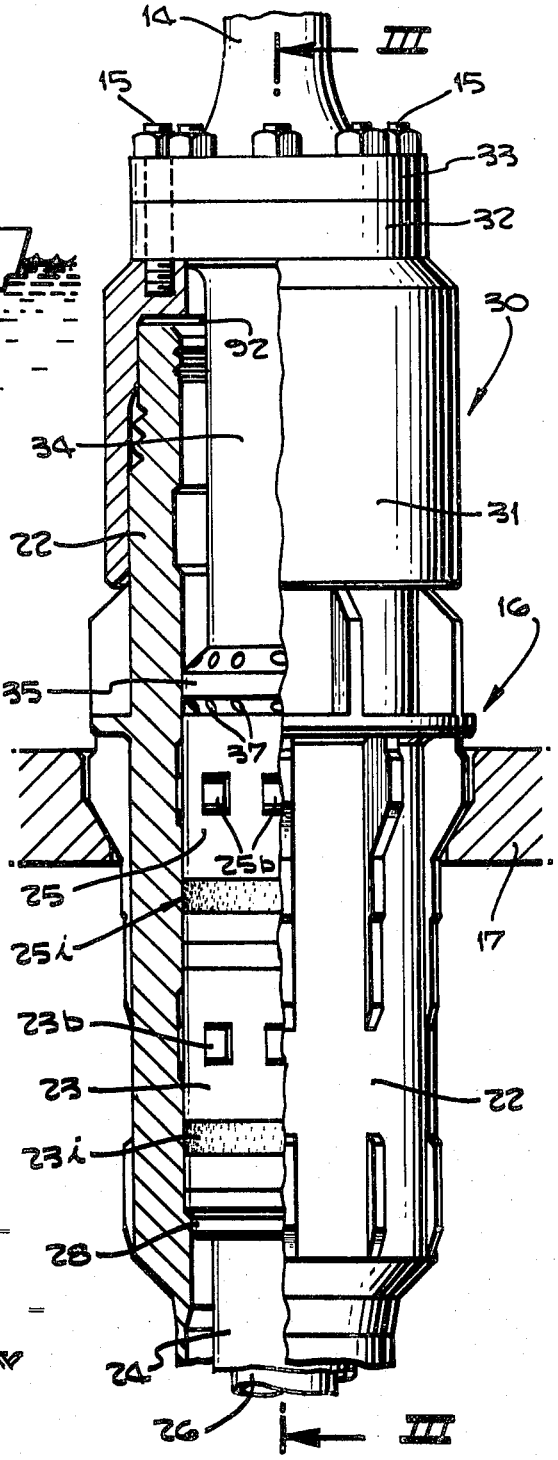
FIG. 2 is an enlarged elevational view, partly in section, of the tie-back apparatus of FIG. 1 when landed in a subsea wellhead.

As shown in FIG. 2, the tie-back apparatus includes an outer flange or guide skirt 31 having a top flange 32 bolted by bolts 15 to a bottom flange 33 on the tapered joint 14. The tie-back apparatus also includes a tubular inner body or mandrel 34 having a guide spool 35 with a plurality of vertical through passages 37 to allow fluid communication on either side of the guide spool 35. Threadingly engaging the mandrel 34 is a liner 36 FIG. 3*a*.

The wellhead assembly 16 includes a wellhead housing 22. The guide skirt 31 contacts the exterior of the wellhead 22, while the guide spool 35 contacts the interior of the wellhead 22 to maintain the mandrel 34 in coaxial alignment with the wellhead 22.

As shown in FIGS. 2, 3*b*, and 3*c*, disposed in the wellhead 22 is a lower casing hanger 23 supporting a casing 24. Above the casing hanger 23 is landed an upper casing hanger 25 supporting another casing 26. It is between this casing 26 and the riser 12 that a seal is effected by the tie-back apparatus. More specifically, the seal is effected between the lower end 34*a* of mandrel portion 34 of the tie-back apparatus, and the body portion 25*d* of the casing hanger 25.

The lower casing hanger 23 includes a body 23*d*, an upper body 23*a*, a plurality of hanger dogs 23*b* urged outwardly by an annular wedge 23*c* adjacent a collar 23*j*. A seal is effected between the casing hanger 23 and the wellhead 22 by an annular seal 23*i* disposed between two annular seal retainers 23*f* and 23*g*. The casing 24 is threaded onto the lower hanger body 23*d*. An annular retainer 23*h* also prevents movement of the seal retainer 23*g*. A plurality of latches 27 mounted in the wellhead 22 engage a shoulder 28 in the casing hanger to retain the casing hanger 23 within the wellhead 22.

Casing hanger 25 has a similar construction to casing hanger 23 and includes a body 25*d*, an upper body 25*a*, a plurality of hanger casing dogs 25*b* maintained in position by an annular wedge 25*c* threaded onto a collar 25*j*. A seal 25*i* is positioned between seal retainers 25*f* and 25*g*. From the hanger body 25*d* is suspended the casing 26.

FIGS. 3*a–c* show the tie-back apparatus 30 immediately after insertion into the wellhead 22. The tie-back apparatus extends downwardly into the casing hanger 25 and effects a metal-to-metal type seal between the mandrel 34 and the hanger body 25*d*, which thereby seals the riser 12 to the casing 26. The lower end 34*a* of the mandrel 34 has attached thereto a metal-to-metal type seal ring 60 by retainer bolts 61 or the like. The metal-to-metal seal is preferably a type AX metal-to-metal seal. To facilitate the sealing of the mandrel 34 to the hanger body 25*d*, the lower mandrel end 34*a* has a tapered seat 37 mating with a tapered back side of the seal 60. The hanger body 25*d* likewise has a tapered seat 29 which mates with the tapered back side of the seal 60. The mating metal-to-metal surfaces between the seal 60 and the tapered seats 37 and 29 effect a seal between the mandrel 34, the seal 60, and the casing hanger 25 upon application of compressive force therebetween. The compressive force is transferred by the tapered seats 37 and 29 to the seal 60. A pair of spaces 90 and 92 between the mandrel 34 and the hanger body 25*d* and between the guide skirt 31 and the wellhead 22, respectively, allow the mandrel 34 to move downwardly in order the transfer the compressive loading to the seal 60.

As described hereinbelow, the present invention latches and seals the tie-back apparatus 30 to the casing hanger 25*d* in the wellhead 22 by the interaction of three locking collets 80, 46, and 44, a drive sleeve 62 and a reaction sleeve 70. FIGS. 3, 6, 7, 8, and 9 show the sequence of operations required to latch the tie-back apparatus to the wellhead 22.

Figure 6:
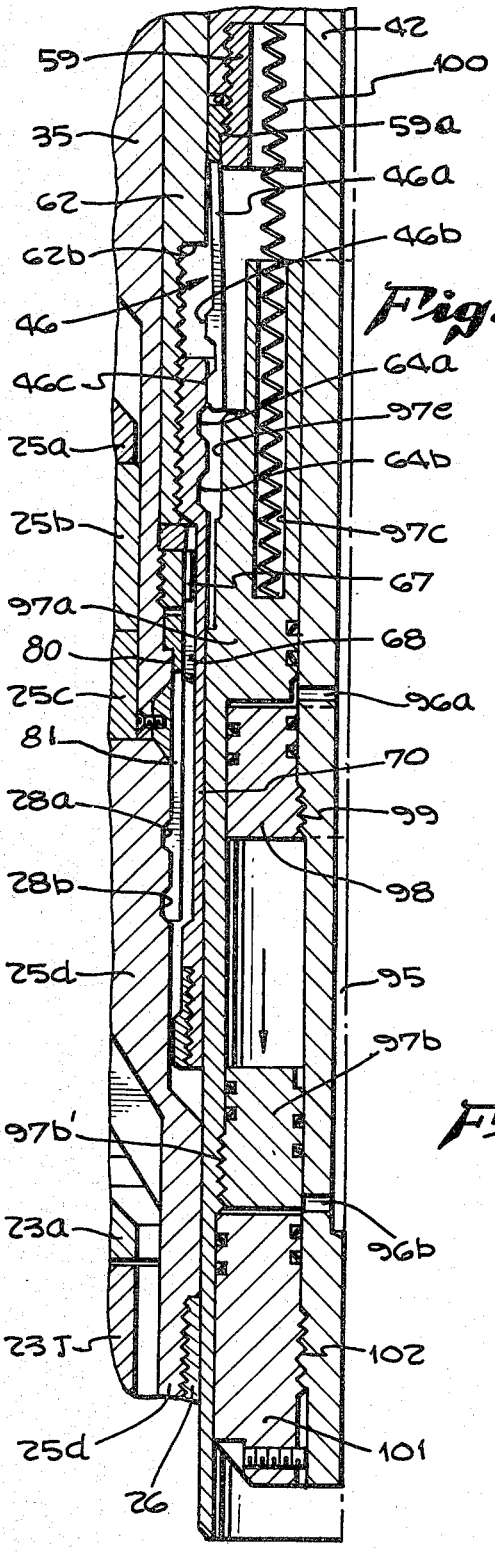
FIG. 6 is an enlarged fragmentary sectional view showing the position of the tie-back apparatus and operating tool immediately after the operating tool has been positioned in the tie-back apparatus.
Figure 9:
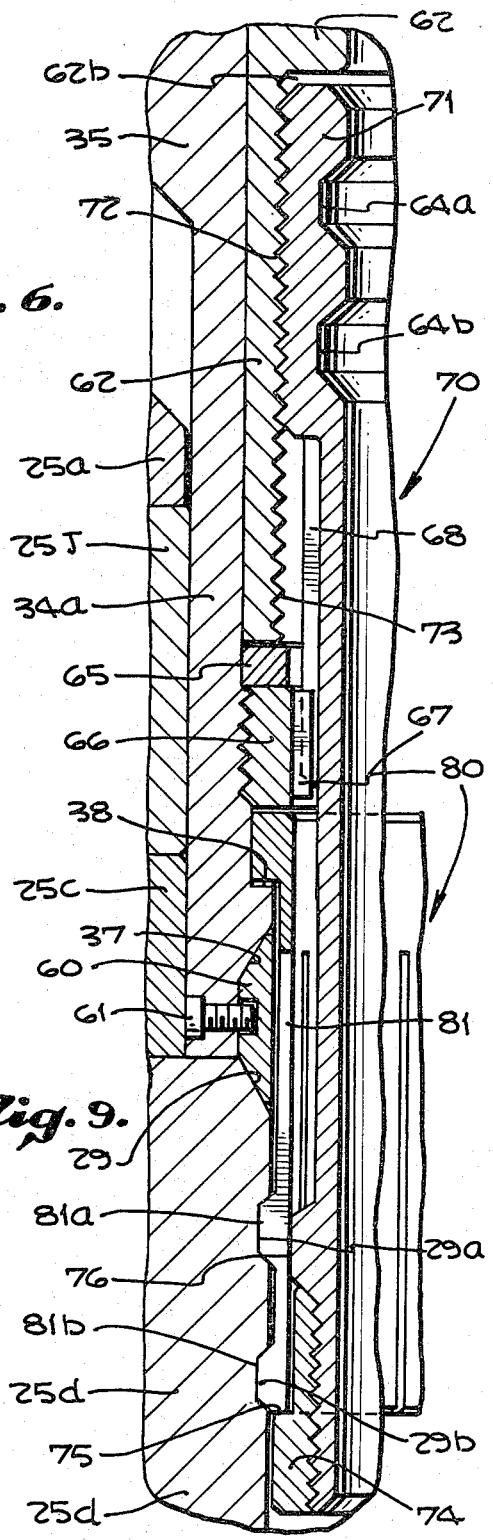
FIG. 9 is an enlarged sectional view showing the seal between the tie-back apparatus and the wellhead after the drive sleeve has been rotated down against the tie-back apparatus to maintain the seal and to allow removal of the operating tool.
Figure 7A:
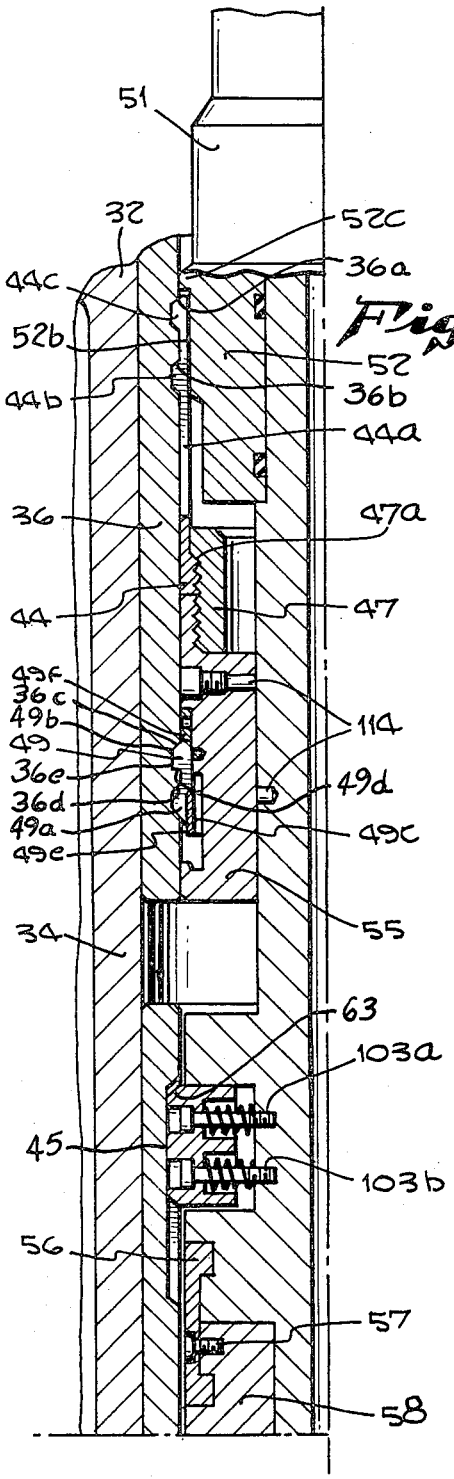
FIG. 7*a* is an enlarged fragmentary sectional view showing the rotation of the operating tool to raise the reaction sleeve portion of the tie-back apparatus to engage a locking collet on the operating tool.
Figure 7B:
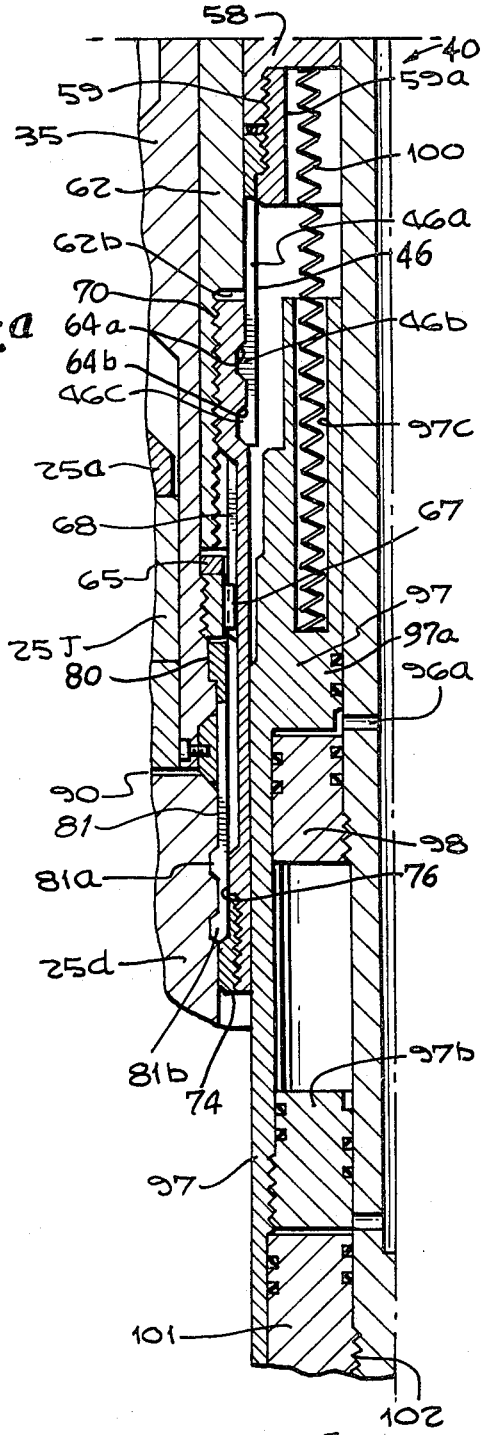
FIG. 7*b* is an enlarged fragmentary sectional view of the tie-back apparatus and operating tool taken below FIG. 7*a;*

Specifically, FIGS. 3*a* through 3*c* show the tie-back connector 30 after landing on the wellhead 22, with the first locking collet 80 latchingly engaging the hanger body 25. FIG. 6 shows the insertion of an operating tool 40 into the tie-back apparatus 30. FIGS. 7*a* and 7*b* show the rotation of the drive sleeve 62 to mechanically raise the reaction sleeve 70 to engage the second collet 46 and to maintain the collet 80 in locking engagement with the hanger body 25. The first collet 80 also limits the upper movement of the reaction sleeve 70. A slight preloading of the seal 60 is effected by the mechanical movement of the reaction sleeve 70 by the drive sleeve 62. FIGS. 8*a* and 8*b* show a piston 97 on the operating tool 40 being moved hydraulically upward until engagement between the reaction sleeve 70 and the second collet 46 occurs, whereupon further application of hydraulic fluid to the piston 97 places the reaction sleeve 70 under axial tension and forces the tool 40 and the mandrel 34, to which the tool 40 is latched by a third collet 44, downwardly toward the casing hanger 25*d*. This places the metal-to-metal seal 60 under compression and thus effects a seal between the mandrel 34 and the casing hanger 25*d*. Thereafter, the drive sleeve 62 is rotated down against a bearing 65 in mandrel 34 to maintain the mandrel 34 urged downwardly and the reaction sleeve 70 under axial tension and thereby allow the piston 97 to be released and the operating tool 40 (FIG. 5) removed from the tie-back apparatus 30, as shown in FIG. 9.

As shown in FIG. 3*b*, the first locking collet 80 is suspended by a rim portion 82 from a shoulder 38 in the lower end 34*a* of the tubular mandrel. The locking collet 80 includes a plurality of fingers 81, with each finger having thereon an upper dog 81*a* and a lower dog 81*b*. The series of upper dogs 81*a* forms an upper annular dog ring, and the series of lower dogs 81*b* forms a lower annular dog ring on the locking collet 80. The upper and lower dogs 81*a* and 81*b* engage annular recesses 28*a* and 28*b*, respectively, in the hanger body 25*d*.

The reaction sleeve 70 is suspended from the mandrel 34 into the hanger body 25*d*. The reaction sleeve 70 includes threads 72 which engage corresponding threads 73 on a drive sleeve 62, as shown in FIG. 3*b*. The reaction sleeve 70 is provided with a collet cam surface 76. Threaded onto the lower end of the reaction sleeve 70 is also an annular stop-collar 74 having an outwardly positioned stop shoulder 75. The reaction sleeve 70 is constrained to move only vertically relative to the collet 80 by means of a spline mechanism including a plurality of spline keys 67 attached to the collar 66 supporting the bearing 65, and a plurality of keyways 68 on the reaction sleeve 70.

The drive sleeve 62 may move both rotatively and linearly within the mandrel 34. Linear movement of the drive sleeve 62 is permitted by means of a gap 62*a* provided above the drive sleeve 62, as shown in FIG. 3*a*. Rotative movement of the drive sleeve 62 is permitted because the drive sleeve 62 slidingly engages the bore of the mandrel 34. The threading engagement between the reaction sleeve 70 and the drive sleeve 62 allows the drive sleeve 62 to move the reaction sleeve 70 upwardly after the tool 40 is inserted into the mandrel bore and rotated. After the tool 40 applies a hydraulic force to the reaction sleeve 70 to axially load it and place the seal 60 under compression, the drive sleeve 62 is rotated downwardly against the bearing 65, which is supported on a collar 66 threaded onto the mandrel 34 to maintain the axial loading on the reaction sleeve 70 to maintain compressive force on the seal 60 and allow removal of the tool 40.

As shown in FIG. 3*b*, when the tie-back apparatus 30 is initially positioned within the wellhead 22, the drive sleeve 62 rests on the bearing 65, with the reaction sleeve 70 being threaded onto the lowermost part of the drive sleeve 62 in order to position the collet cam 76 and the stop shoulder 75 away from the locking fingers 81. This position of the reaction sleeve 70 allows the locking fingers 81 to deflect and follow the contour of the casing hanger 25 without getting caught thereon as the tie-back connector 30 is lowered into the wellhead.

As shown in FIGS. 7*a* and 7*b*, the operating tool 40, which is subsequently lowered into the tie-back apparatus and latched on to the mandrel liner 36, will first impart rotative force to the drive sleeve 62 through a plurality of dog-receiving recesses 63 in the drive sleeve in order to place a pair of locating dog recesses 64*a* and 64*b* on the reaction sleeve 70 into engagement with the second locking collet 46 suspended from the operating tool, and also to place the collet cam 76 behind the fingers 81 of the first collet 80 to maintain the collet 80 in locking engagement with the hanger body 25*d*. The raising of the reaction sleeve 70 continues until the stop collar 74 makes contact with the bottoms of the locking fingers 81. A slight preload will be placed on the seal 60 at this time as the drive sleeve 62 will be bearing down against the bearing 65.

As shown in FIGS. 8*a* and 8*b*, the next operation of the tool is to apply hydraulic force to the reaction sleeve 70 to draw the mandrel 34 toward the casing hanger body 25*d* to compress the seal 60. The drawing down of the mandrel 34 is made possible by the locking engagement of the fingers of the collet 44 with the mandrel sleeve 36, which threadingly engages the mandrel 34.

More specifically, the piston 97 on the tool 40 is hydraulically urged upward until a shoulder 97*d* on the piston 97 makes contact with the bottoms of the fingers 46*a* of the collet 46. When this occurs, a surface 97*e* of the piston 97 is positioned behind the fingers 46*a* of the collet 46 to prevent the disengagement of the dogs 46*b* and 46*c* with the recesses 64*a* and 64*b* on the reaction sleeve 70. The hydraulic force applied to the reaction sleeve 70 by the piston shoulder 97*d* will axially tension the reaction sleeve 70 and lift the drive sleeve 62 slightly off the bearing 65.

As the piston 97 at this point can no longer move upwardly, continued application of hydraulic pressure will push the operating tool 40 (via shoulders 98 and 101 as described below) into the casing hanger body 25*d*. This will push a shoulder 52*c* in an upper collar 52 on the tool 40 down against the fingers 44*a* in the collet 44. This downward force will be exerted against the mandrel sleeve 36 and thus the mandrel 34. As a result, the mandrel 34 will be tightly drawn against the casing hanger body 25*d*, thereby placing the seal 60 under compressive force. The tapered seats 37 and 29 on the mandrel lower end 34*a* and casing hanger body 25*d*, respectively, transmit the compressive loading to the seal 60 as the mandrel 34 is drawn into the casing hanger body 25. No space remains between the mandrel 34 and the casing hanger body 25*d* after the seal 60 is placed under compression.

After the hydraulic force has moved the mandrel 34 against the casing hanger 25, the drive sleeve 62 is rotated downwardly by the tool 40 against the bearing 65 to maintain axial tension on the reaction sleeve 70 and thus maintain the compressive loading on the seal 60 to allow the hydraulic force to be released. The final positions of the drive sleeve 62, reaction sleeve 70, and locking collet 80 are shown in FIG. 9.

The dog receiving recesses 63 on the drive sleeve 62 are vertically elongated and designed to receive a dog of lesser elongation to allow the drive sleeve to move relative to the dog as the dog imparts rotative motion to the drive sleeve 62. The drive sleeve 62 is also provided with a small recess 62*b* to insure that the drive sleeve 62 does not bottom against the reaction sleeve 70 as it is being rotated downwardly.

Figure 10:
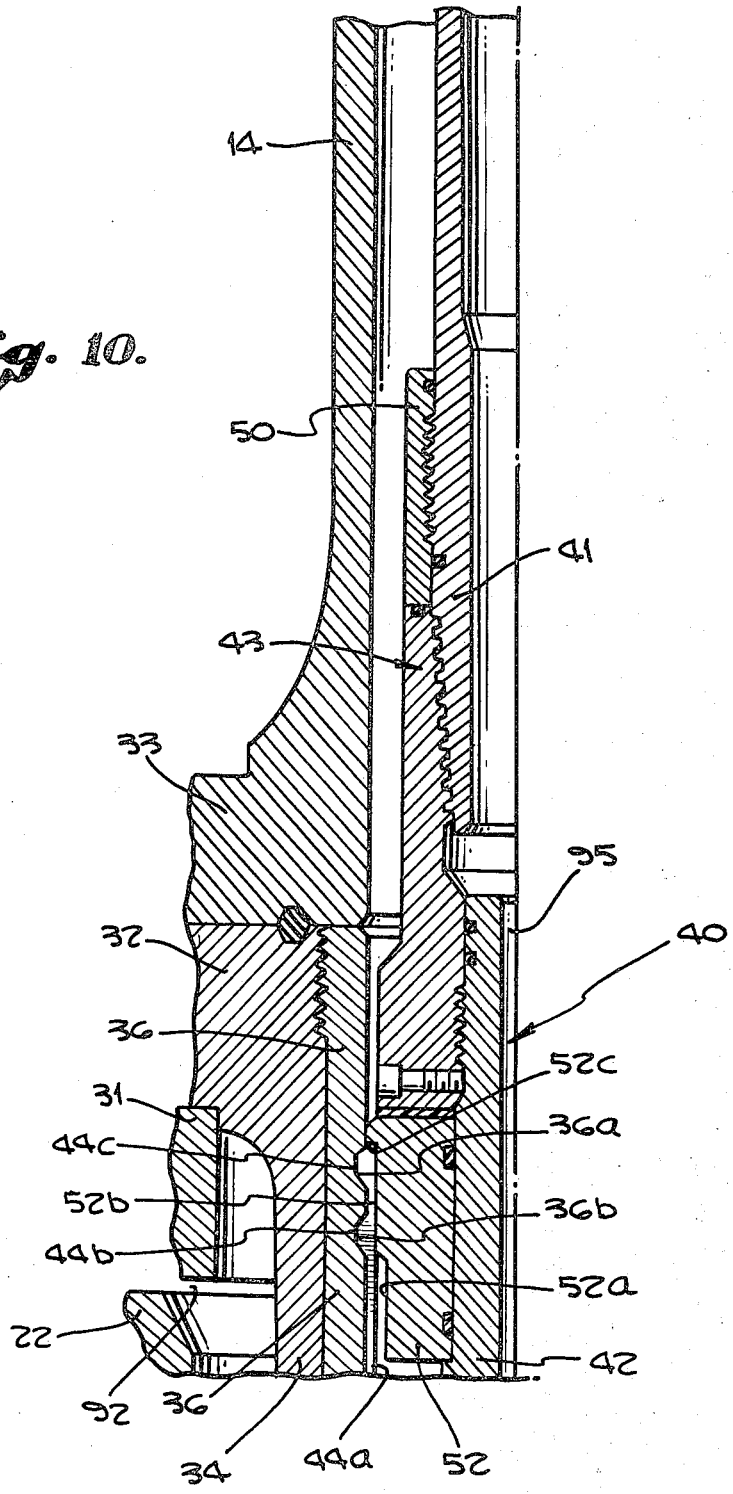
FIG. 10 is a sectional view of the operating tool of FIG. 4, taken through the plane X—X.

FIGS. 4, 5, and 10 show the operating tool 40 which is used to: (a) rotate the drive sleeve 62 to move the reaction sleeve 70 vertically upward; (b) hydraulically apply force to the reaction sleeve 70 to move the mandrel 34 downwardly to compress the seal 60; and (c) rotate the drive sleeve 62 downwardly to maintain the axial loading on the reaction sleeve 70 and thus allow the hydraulic force to be released.

The operating tool 40 has a tool body 42 attached to a running string 41 connected to the floating vessel 10 by tubing not shown in the figures. The running string 41 is connected to the tool body 42 through a coupling 43 as shown in FIG. 10. This coupling is described in U.S. Pat. No. 3,762,745, the description of which is incorporated by reference herein. Briefly, the coupling includes a tapered acme thread with extra clearance to allow axial movement between the pin and box portions of the thread. The threads are splined at the lower engaging end such that a nut 50 is tightened to pull the pin upward and engage the splines and thereby provide both locking and unlocking torque to the tool 40. Stated differently, turning the running string 41 tightens the collar in the acme/splined thread arrangement to allow the loose thread to move axially and engage the splined thread to allow rotation of the tool 40 in the direction of rotation of the running string 41.

As shown in FIG. 5, the tool body 42 is provided with a plurality of spring biased dogs 45 which engage the dog receiving recesses 63 in the drive sleeve 62. Each of these dogs 45 is attached to a pair of retaining bolts 103*a* and 103*b*, each having positioned on its shank a spring 104*a* and 104*b*. The dog 45 are thereby urged outwardly from the lower tool body 42 to follow the contours of the wellhead 22 and drive sleeve 62 into a position within the dog receiving recesses 63 on the drive sleeve 62.

As shown in FIGS. 4, 5, 7*a*, and 10, proper vertical registration of the operating tool 40 in the tie-back apparatus 30 is assured by the aforementioned third locking collet 44, which has a plurality of locking fingers 44*a* each supporting a pair of dogs 44*b* and 44*c*, and also by a dog ring 49 having a series of fingers 49*a* on a ring 49*e*, each supporting a pair of dogs 49*b* and 49*c* with a rim 49*d* being formed by the lower side of the upper dogs 49*b*. A stop ring 49*f* is also formed at the upper end of the fingers 49*a*. The third collet 44 is mounted against a shoulder 47*a* in an annular collar 47 which is threaded onto a lower collar 55 disposed on the outside of the tool body 42. The lower collar 55 also supports the dog ring 49.

FIGS. 4 and 5 shows the position of the lower collar 55, the dog ring 49, and the third collet 44 prior to the insertion of the tool 40 into the tie-back connector 30. The locking fingers 44*a* of the third collet 44 are disposed vertically upward and adjacent a recess 52*a* on an upper collar 52 attached to the tool body 42 behind the locking fingers 44*a*. The fingers 44*a* can flex into the recess 52*a* as the tool 40 is inserted into the mandrel 34. The lower collar 55 is constrained for movement relative to the tool body 42 by a plurality of shear pins 114, only one of which is shown in FIG. 5. The dog ring 49 is disposed within a recess 55*a* on the lower collar 55, and maintained in that recess by a plurality of shear pins 54, only one of which is shown, extending through the dog ring 49 into the lower collar 55, as well as by the stop ring 49*f*.

As shown in FIG. 7*a*, the third collet 44 is adapted to engage a pair of annular dog receiving recesses 36*a* and 36*b* in the sleeve 36 attached to the mandrel 34. It is against these recesses 36*a* and 36*b* that the fingers 44*a* of the third collet 44 bear as the tool 40 hydraulically compresses the seal 60. More specifically, application of the hydraulic force pulls the shoulder 52*c* on the upper collar 52 down against the top of the fingers 44*a* and urges the mandrel liner 36 and thus the mandrel 34 to which it is threadingly engaged downwardly.

The dog ring 49 is adapted to engage another pair of annular recesses 36*c* and 36*d* in the liner 36. One of these recesses 36*c* is formed to have a shoulder 36*e* which engages the rim 49*d* on the dog ring 49.

Accordingly, as the operating tool 40 is lowered into the mandrel 34, the fingers 49*a* of the dog ring 49 follow the contours of the liner sleeve 36 until engagement is made between the shoulder 36*e* on the sleeve and the rim 49*d* on the dog ring 49. When this occurs, and as shown in FIG. 7*a*, the dogs 49*b* and 49*c* of the dog ring engage the lower two annular recesses 36*c* and 36*d* as the operating tool 40 continues to be lowered into the mandrel 34. This prevents the dog ring 49 from moving further and causes the dog ring 49 to shear the shear pin 54 FIG. 4 and impact a shoulder 55*c* on the lower collar 55. When this occurs, the lower collar 55 is prevented from moving relative to the mandrel 34 as the operating tool 40 continues to be lowered. The lower collar 55 thereafter shears the shear pin 114 as the operating tool 40 continues to move downwardly. The continued downward movement of the tool 40 causes the fingers 44*a* of the third collet to be backed up by a surface 52*b* on upper collar 52. At this point, the dogs 44*b* and 44*c* on the fingers 44 engage the upper two annular recesses 36*a* and 36*b* in the liner sleeve 36. Downward movement of the tool 40 finally ceases when the uppermost portion of the locking fingers 44 engage the shoulder 52*c* on the upper collar 52.

As shown in FIG. 6, immediately after the tie-back apparatus 30 is inserted into the wellhead 22, the dogs 46*b* and 46*c* on the locking fingers 46*a* of the collet 46 are not engaged with the recesses 64*a* and 64*b* in the reaction sleeve 70 due to the lowered position thereof. The second collet 46 is suspended from a shoulder 59*a* on a collar 59 threaded onto another collar 58 attached to the operating tool lower body 42 by means of a flanged collar 56 and a screw 57 (FIG. 7*a*) and is thus immoveable. Accordingly, after the operating tool 40 is inserted into the wellhead 22, the reaction sleeve 70 must be moved upwardly relative to the drive sleeve 62 in order to allow the locating dog recesses 64*a* and 64*b* on the reaction sleeve 70 to engage the dogs 46*b* and 46*c* on the locking fingers 46*a* of the second collet 46, and also to maintain the fingers 81 of the first collet 80 engaged with the casing hanger body 25*d*. This is done by rotating the drive sleeve 62 by means of the dogs 45, (FIG. 7*a*) which engage the elongated dog receiving recesses 63. As the reaction sleeve 70 is constrained for only vertical movement relative to the mandrel 34 by means of the spline key 67 and the keyway 68 (FIG. 3*b*), rotating the drive sleeve in the proper direction moves the reaction sleeve upwardly. The reaction sleeve is moved upwardly as previously described, whereupon the dog receiving recesses 64*a* and 64*b* engage the locking collet dogs 46*b* and 46*c* and a slight preload is placed on the seal 60. After this is done, the position of the reaction sleeve is as shown in FIG. 7*b*.

After the reaction sleeve 70 has been raised, hydraulic force is applied to the reaction sleeve 70 by the annular piston 97 slidably mounted on the lower tool body 42. Referring to FIGS. 8*a* and 8*b*, annular piston 97 includes an integral upper inner shoulder 97*a*, a separate lower shoulder 97*b* attached to the piston 97 by threads 97*b'*, a plurality of annular spring cavities 97*c* each containing a spring 100 (only one of each of which have been shown), an outer shoulder 97*d* and a portion of recessed diameter forming a landing 97*e*. The springs 100 bias the piston 97 downwardly until such time as the piston 97 is urged upwardly relative to the tool body 42 by means of hydraulic fluid supplied via a hydraulic control line 95 to a pair of ports 96*a* and 96*b*. Hydraulic fluid is supplied between the inner shoulders 97*a* and 97*b* of the piston 97 and a pair of shoulders 98 and 101 threaded onto the lower tool body 42 by threads 99 and 102, respectively. Forcing hydraulic fluid between the respective shoulders on the piston 97 and tool body 42 causes the piston to move upwardly relative to the tool body.

The upward movement of the piston 97 moves the landing 97*e* behind the locking fingers 46*a* of the second collet 46 to retain the dogs 46*b* and 46*c* in the locating dog recesses 64*a* and 64*b* of the reaction sleeve 70. The upward movement of the piston 97 continues until contact is made with the bottoms of the fingers 46*a*. This contact causes a slight upward movement of both the reaction sleeve 70 and the drive sleeve 62 as shown in FIG. 8*a*. Further upward movement of the piston 97 is thereafter inhibited, causing the reaction sleeve 70 to be axially tensioned.

Continued application of hydraulic pressure pushes the shoulders 98 and 101 attached to the tool body 42 downwardly. This causes the shoulder 52*c* on the upper collar 52 to bear downwardly against the fingers 44*a* of the third collet 44 and push the mandrel downwardly toward the casing hanger body 25*d* to compress the seal 60.

After compression has been hydraulically applied to the seal 60, the compressive force is maintained on the seal 60 by maintaining axial tension on the reaction sleeve 70. This is done by rotating the drive sleeve 62 down against the bearing 65. The rotation is continued until the force applied to the reaction sleeve by the piston 97 has been transferred to the drive sleeve 62. That is, the drive sleeve 62 is rotated until it completely supports the position of the reaction sleeve 70 resulting from the hydraulic actuation of the piston 97.

After the hydraulic force has been mechanically maintained by the rotation of the drive sleeve 62 downwardly against the bearing 65, the hydraulic force is released by releasing the hydraulic fluid and the piston 97 moves downwardly under the urging of the spring 100. The operating tool may thereafter be pulled upwardly out of the drive sleeve 62. The tapered upper contours of the dogs 44*b, c*, 49*b, c*, 45, and 46*b, c* facilitate the removal of the tool 40. FIG. 9 shows the tie-back apparatus after the removal of the tool 40.

The operating tool 40 may be lowered back into the drive sleeve 62 in order to release the seal between the mandrel 34 and the casing hanger by reversing the sequence described above. Thereafter, both the operating tool 40 and the tie-back connector apparatus 30 can be removed from the wellhead 22.

As seen from the foregoing, the present invention provides a novel method and apparatus for remotely latching and sealing a tie-back string to a wellhead. The method includes the attaching of the tie-back connector 30 to the wellhead 22 by inserting the mandrel 34 into the wellhead 22 with the guide skirt 31 and the guide spool 35 respectively following the inner and outer contours of the wellhead. The ports 37 in the guide spool 35 allow displacement of fluid through the guide spool to facilitate the lowering of the mandrel 34 into the wellhead 22. The lowering continues until the seal 60 contacts the shoulder 29 on the hanger body 25*d*.

Once the mandrel is landed, the operating tool 40 previously described is inserted into the drive sleeve 62 to rotate the sleeve and thereby raise the reaction sleeve 70 and preload the seal 60. The piston 97 in the operating tool 40 is thereafter hydraulically actuated to compress the seal 60. The drive sleeve 62 is then rotated down against the mandrel 34 to retain the force applied to the reaction sleeve and allow the hydraulic piston to be released and the operating tool removed.

In the foregoing description of the present invention, a preferred embodiment of the invention has been disclosed. It is to be understood that other mechanical and design variations are within the scope of the present invention. Accordingly, the invention is not limited to the particular arrangement which has been illustrated and described in detail herein.

What is claimed is:

1. A tie back connection apparatus for effecting a metal-to-metal type seal between a riser run from an overhead vessel and a subsea well casing suspended from a casing hanger in a subsea wellhead member, said connection apparatus comprising:

a tubular mandrel connected to and run by said riser to said subsea wellhead member, with the bore of said mandrel communicating with the bore of said riser;

a metal-to-metal type annular seal ring mounted at a lower end of said mandrel, said mandrel lower end and said seal ring having mating metal-to-metal surfaces to effect a seal therebetween upon application of compressive force thereon;

guide means for guiding said mandrel within said wellhead member to position said mandrel lower end in coaxial alignment with said casing hanger with said seal ring positioned therebetween, said seal ring and said casing hanger having mating metal-to-metal surfaces to effect a seal therebetween upon application of compressive force thereon; and seal activating means, responsive to a linear sealing force and a rotative seal retaining force, for applying a compressive force between said seal ring, said mandrel and said casing hanger to effect a sealed connection between said riser and said casing in response to said linear force and for maintaining said compressive force in reponse to said rotative force.

2. An apparatus as defined in claim 1, wherein:

said linear force is a hydraulic force; and said rotative force is a mechanical force.

3. An apparatus as defined in claim 2, wherein said apparatus further comprises:

an operating tool run from said vessel through said riser into said mandrel to first apply said hydraulic force to said seal activating means to seal said connection, and thereafter to apply said mechanical force to said seal activating means to maintain said connection.

4. A tieback apparatus for effecting a metal-to-metal seal between a riser run from an overhead vessel and a subsea well casing suspended from a casing hanger in a subsea wellhead, said apparatus comprising:

a hollow mandrel connected to and run by said riser into said well head, said mandrel having a bore communicating with the bore of said riser;

metal seal ring means disposed at the lower end of said mandrel, said ring means being landed upon said casing hanger when said mandrel is run into said wellhead;

seal compressing means, responsive to a hydraulic linear sealing force and to a mechanical rotative seal retention force, for applying a compressive force between said ring means, said mandrel, and said casing hanger in response to said hydraulic force and for maintaining said compressive force in response to said rotative force; and operating tool means, run from said vessel into said mandrel, for first applying said hydraulic force to said seal compressing means and for thereafter applying said rotative force to said seal compressing means.

5. A tieback apparatus for effecting a metal-to-metal type seal between a riser run from an overhead vessel and a subsea well casing suspended from a casing hanger in a subsea wellhead, said apparatus comprising:

a hollow mandrel connected to and run by said riser into said subsea wellhead, said mandrel having a bore communicating with the bore of said riser;

metal-to-metal seal ring means;

fastening means for mounting said ring means at the lower end of said mandrel, whereby said ring means is landed upon said casing hanger when said mandrel is run into said wellhead;

seal compressing means, responsive to a hydraulic linear sealing force and to a mechanical rotative seal retaining force, for applying a compressive force between said ring means, said mandrel, and said casing hanger in response to said hydraulic force and for maintaining said compressive force in response to said rotative force;

mating metal-to-metal surfaces on said mandrel lower end, said ring means, and said casing hanger, said metal surfaces on said mandrel and said casing hanger each comprising a tapered annular seat, and said metal surfaces on said ring means comprising a tapered annular shoulder, with said shoulders abutting said seats, whereby said seats transfer said compressive force applied by said seal compressing means to said shoulders to seal said connection between said riser and said casing;

guide means for guiding and maintaining said mandrel lower end in concentric coaxial alignment with said casing hanger with said ring means positioned therebetween, said guide means including a guide skirt attached to said mandrel and contacting an upper surface of said well head, and a guide spool attached to said mandrel and contacting an inner surface of said well head, said guide spool being disposed below said guide skirt and including a plurality of through-bores for allowing fluid communication vertically through said spool; and operating tool means, run from said vessel into said mandrel for first applying said hydraulic force to said seal compressing means and for thereafter applying said rotative force to said seal compressing means.

6. A tieback apparatus for effecting a metal-to-metal type seal between a riser run from an overhead vessel and a subsea well casing suspended from a casing hanger in a subsea wellhead member, said apparatus comprising:

a tubular mandrel connected to and run by said riser into said subsea wellhead, with the bore of said mandrel communicating with the bore of said riser;

a metal-to-metal type annular seal ring mounted at a lower end of said mandrel, said mandrel lower end and said seal ring having mating metal-to-metal surfaces to effect a seal therebetween upon the application of compressive force thereon;

guide means for guiding said mandrel within said wellhead member to position said mandrel lower end in coaxial alignment with the casing hanger with said seal ring positioned therebetween, said seal ring and said casing hanger having mating metal-to-metal surfaces to effect a seal therebetween upon application of compressive thereon;

locking collet means, suspended from said mandrel and extending into the bore of said casing hanger, for latchingly engaging said mandrel;

drive sleeve means slidably mounted within said mandrel for both linear and rotative movement relative thereto; and reaction sleeve means, slidably mounted for and constrained to linear movement within said mandrel and threadingly engaging said drive sleeve means, for maintaining said locking collet means in latching engagement with said casing hanger, for causing said mandrel to move downwardly against said wellhead in response to said linear hydraulic force when said force is applied to said reaction sleeve means, and for maintaining said force when said drive sleeve means is rotated downwardly against said mandrel, whereby said drive sleeve means is first rotated to move said reaction sleeve means upwardly to maintain said locking collet means engaged with said casing hanger, said linear hydraulic force thereafter further urging said reaction sleeve means vertically upward to effect downward movement of said mandrel against said casing hanger to apply said compressive force, said mechanical rotative force thereafter rotating said drive sleeve means downwardly against said mandrel to maintain said reaction sleeve means urged upwardly to maintain said compressive force and to allow said hydraulic force to be released; and an operating tool run from said vessel through said riser into said mandrel to first apply said hydraulic force to said seal activating means to seal said connection, and thereafter to apply said mechanical force to said seal activating means to maintain said connection.

7. An apparatus as defined in claim 6, wherein:

said casing hanger includes dog receiving means for receiving said locking collet means;

said mandrel includes bearing means for providing a bearing surface for said drive sleeve means;

said locking collet means includes a plurality of locking finger means, and a plurality of dog means disposed on each of said finger means for locking engagement with said dog receiving means in said casing hanger;

said reaction sleeve means includes cam means for maintaining said dog means in locking engagement with said dog receiving means and stop means for limiting vertical movement of said reaction sleeve means, whereby said drive sleeve means is first rotated to move said reaction sleeve means upwardly to position said cam means behind said dog means and to place said stop means in contact with said finger means, said hydraulic force thereafter being applied to said reaction sleeve means to urge said reaction sleeve means vertically upward, said stop means limiting upward movement of said reaction sleeve means, said hydraulic force thereby urging said mandrel downwardly against said casing hanger to apply said compressive force to said seal ring, mandrel, and casing hanger to effect said seal therebetween, said mechanical force thereafter rotating said drive sleeve means downwardly against said bearing means to urge said reaction sleeve means upwardly to maintain said compressive force and thereby allow said hydraulic force to be released.

8. An apparatus as defined in claim 7, wherein:

said mandrel includes key means; and said reaction sleeve includes keyway means, engaging said key means, for constraining said reaction sleeve means to linear movement relative to said mandrel.

9. An apparatus as defined in claim 6, wherein said operating tool means comprises:

a tool body run by tubing from said vessel through said riser into said mandrel;

vertical registration means, engaging said mandrel, for positioning said tool body in said mandrel bore;

second locking collet means for engaging said reaction sleeve means when said reaction sleeve means is rotated upwardly by said drive sleeve means;

third locking collet means for engaging said mandrel;

annular piston means, hydraulically actuatable for upward vertical movement relative to said tool body, for urging said second collet means and said reaction sleeve means vertically upward, said upward movement being limited by said first locking collet means, said hydraulic force thereafter urging said third locking collet means and said mandrel downwardly to apply said compressive force; and dog means engaging said drive sleeve means, for imparting rotation thereto.

10. An apparatus as defined in claim 9, wherein:

said operating tool means further comprises means for connecting said tool body to said tubing to allow clockwise and counterclockwise rotation of said tool means to effect rotation of said drive sleeve means; and means for supplying hydraulic fluid to said piston means to effect said upward vertical movement of said piston means.

11. An apparatus as defined in claim 9, wherein:

said mandrel includes first and second annular recess means disposed above said drive sleeve means, said second annular recess means including an annular rim;

said drive sleeve means includes dog receiving means;

said dog means comprises a plurality of outwardly-biased dogs circumferentially positioned within said tool body to engage said dog receiving means in said drive sleeve means;

said vertical registration means comprises dog ring means, including a plurality of circumferentially positioned fingers each having a pair of dogs, for engaging said second annular recess means in said mandrel, said dog ring means having an annular shoulder, whereby said operating tool means is lowered into said mandrel until said shoulder in said dog ring means engages said rim in said second annular recess means, further lowering of said operating tool means thereafter being prevented and said plurality of dogs on said operating tool engaging said dog receiving means on said drive sleeve;

said third locking collet means includes a plurality of locking fingers engaging said first annular recess means in said mandrel;

said reaction sleeve means includes annular recess means;

said second locking collet means includes a plurality of locking fingers for engaging said annular recess means on said reaction sleeve means when said drive sleeve means moves said reaction sleeve means vertically upward;

said operating tool body includes stationary shoulder means and means for applying hydraulic fluid to said annular piston means;

said annular piston means comprises an annular piston externally mounted on said tool body adjacent said stationary shoulder means and including internal rim means disposed adjacent said stationary shoulder means and further includes exterior rim means, whereby after said drive sleeve means has been rotated to move said reaction sleeve vertically upward, said hydraulic fluid is forced between said stationary shoulder means in said tool body and said internal rim means on said annular piston to move said piston upwardly relative to said tool body to bring said external rim means into contact with said fingers of second locking collet means to urge said reaction sleeve means vertically upward, with said first locking collet means limiting said vertical movement, whereupon said hydraulic force is applied against said stationary shoulder means to urge said third collet means and thereby said mandrel downwardly against said casing hanger to apply said compressive force, said drive sleeve means thereafter being rotated downwardly against said mandrel to maintain said compressive force and allow the releasing of said hydraulic fluid to permit said piston to move downwardly and allow said operating tool means to be removed from said mandrel.

12. An apparatus as defined in claim 11, wherein:

said operating tool includes shear pin means for restraining said dog ring means from movement until said annular shoulder on said dog ring means engages said annular rim as said operating tool means is lowered into said drive sleeve means, whereupon said dog ring means is pulled upwardly and said shear pin means is severed;

said piston means includes spring means for biasing said annular piston downwardly as said operating tool means is lowered into said mandrel;

said internal rim means on said annular piston comprises a pair of internal rims;

said external rim means on said annular piston comprises an external rim; and said stationary shoulder means on said tool body includes a pair of stationary shoulders, with said hydraulic fluid being forced between said stationary shoulders and said internal rim.

13. An operating tool for applying a linear hydraulic sealing force to a reaction sleeve slidably mounted for linear movement within a tieback apparatus run by a riser from an overhead vessel into a subsea wellhead, and for thereafter applying a rotative mechanical seal retaining force to a drive sleeve in said tieback apparatus threadingly engaging said reaction sleeve, said tieback apparatus having a metal seal ring disposed at the lower end of a tubular mandrel and landed upon a casing hanger supporting a casing in said wellhead, said tieback apparatus effecting a metal-to-metal seal between said riser and said casing by applying a compressive force to said mandrel, seal ring, and said casing hanger in response to said hydraulic sealing force, said tieback apparatus maintaining said compressive force in response to said mechanical force, said operating tool comprising:

a tool body run by tubing from said vessel to said riser into said mandrel;

vertical registration means, engaging said mandrel, for positioning said tool body in said mandrel bore;

annular piston means, hydraulically actuatable for upward vertical movement relative to said tool body, for applying axial tension to said reaction sleeve to urge said mandrel downwardly against said casing hanger to apply said compressive force to said seal;

means for supplying hydraulic fluid to said piston means to effect said upward vertical movement of said piston means;

dog means for engaging said drive sleeve, whereby said dog means is first rotated to move said reaction sleeve vertically upward into registration with said piston means, said piston means thereafter axially loading said reaction sleeve to cause said compressive force to be applied to said seal, said dog means thereafter being again rotated to rotate said drive sleeve downwardly against said mandrel to maintain said compressive force and allow said piston means to be released from engagement with said reaction sleeve; and means, connecting said tool body to said tubing, for allowing both clockwise and counter-clockwise rotation of said operating tool to effect rotation of said drive sleeve.

14. A method of effecting a seal between a riser run from an overhead vessel and a subsea wellhead casing suspended from a casing hanger in a subsea wellhead member, said method comprising the steps of:

lowering a mandrel attached to said riser and having a metal-to-metal type annular seal ring mounted at the lower end thereof into said subsea well member;

landing said annular seal on and in coaxial alignment with said casing hanger, whereby a connection between said seal ring, said riser, and said casing is effected;

hydraulically applying an axial compressive force to said seal ring, mandrel, and casing hanger to seal said effective connection; and mechanically retaining said compressive force.

15. A method of effecting a seal between a riser run from an overhead vessel and a subsea wellhead casing suspended from a casing hanger in a subsea wellhead member, said method comprising the steps of:

lowering a mandrel attached to said riser and having a metal-to-metal type annular seal ring mounted at the lower end thereof into said subsea well member;

landing said annular seal on and in coaxial alignment with said casing hanger, whereby a connection between said seal ring, said riser, and said casing is effected;

hydraulically applying a compressive force to said seal ring, mandrel, and casing hanger to seal said effective connection; and mechanically retaining said compressive force;

wherein said step of applying compressive force comprises the steps of:

providing a reaction sleeve constrained for vertical movement within said mandrel and threadingly suspended from a drive sleeve slidably mounted within said mandrel;

hydraulically applying tension to said reaction sleeve to urge said reaction sleeve upwardly; and preventing said reaction sleeve from moving upwardly and thereby applying said hydraulic force downwardly against said mandrel to move said mandrel against said casing hanger to apply said compressive force.

16. A method of effecting a seal between a riser run from an overhead vessel and a subsea wellhead casing suspended from a casing hanger in a subsea wellhead member, said method comprising the steps of:

lowering a mandrel attached to said riser and having a metal-to-metal type annular seal ring mounted at the lower end thereof into said subsea well member;

landing said annular seal on and in coaxial alignment with said casing hanger, whereby a connection between said seal ring, said riser, and said casing is effected;

hydraulically applying a compressive force to said seal ring, mandrel, and casing hanger to seal said effective connection; and mechanically retaining said compressive force;

said step of applying compressive force comprising the steps of:

providing a reaction sleeve constrained for vertical movement within said mandrel and threadingly suspended from a drive sleeve slidably mounted within said mandrel;

hydraulically applying tension to said reaction sleeve to urge said reaction sleeve upwardly; and preventing said reaction sleeve from moving upwardly and thereby applying said hydraulic force downwardly against said mandrel to move said mandrel against said casing hanger to apply said compressive force;

wherein said step of retaining said compressive force comprises the steps of:

maintaining said axial tension on said reaction sleeve; and mechanically rotating said drive sleeve downwardly against said mandrel to prevent downward movement of said reaction sleeve and thereby maintain said compressive force.

17. A method of effecting a seal between a riser run from an overhead vessel and a subsea wellhead casing suspended from a casing hanger in a subsea wellhead member, said method comprising the steps of:

lowering a mandrel attached to said riser and having a metal-to-metal type annular seal ring mounted at the lower end thereof into said subsea well member;

landing said annular seal on and in coaxial alignment with said casing hanger, whereby a connection between said seal ring, said riser, and said casing is effected;

hydraulically applying a compressive force to said seal ring, mandrel, and casing hanger to seal said effective connection; and mechanically retaining said compressive force;

said step of applying compressive force comprising the steps of:

providing a reaction sleeve constrained for vertical movement within said mandrel and threadingly suspended from a drive sleeve slidably mounted within said mandrel;

hydraulically applying tension to said reaction sleeve to urge said reaction sleeve upwardly; and preventing said reaction sleeve from moving upwardly and thereby applying said hydraulic force downwardly against said mandrel to move said mandrel against said casing hanger to apply said compressive force;

said step of retaining said compressive force comprising the steps of:

maintaining said axial tension on said reaction sleeve; and mechanically rotating said drive sleeve downwardly against said mandrel to prevent downward movement of said reaction sleeve and thereby maintain said compressive force;

wherein:

said step of hydraulically applying axial tension to said reaction sleeve comprises inserting an operating tool downwardly into said drive sleeve and moving an annular piston on said tool upwardly against said reaction sleeve;

said step of preventing said reaction sleeve from moving and thereby applying said hydraulic force to said mandrel comprises urging said sleeve against a first locking collet suspended from said mandrel in latching engagement with said casing hanger, said first collet preventing said sleeve from moving and causing said hydraulic force to urge downwardly a second locking collet attached to said tool and latchingly engaging said mandrel, thereby also urging said mandrel downwardly against said casing hanger to apply said compressive force; and said step of mechanically rotating said drive sleeve comprises rotating said drive sleeve downwardly against said mandrel, said hydraulic force being thereafter released and said operating tool removed from said drive sleeve.

* * * * *